United States Patent [19]

Tsutsui et al.

[11] 4,280,078

[45] Jul. 21, 1981

[54] MAGNETRON

[75] Inventors: Kenziro Tsutsui, Otsu; Masamitsu Kakei, Hikone, both of Japan

[73] Assignee: New Nippon Electric Co. Ltd., Osaka, Japan

[21] Appl. No.: 103,949

[22] PCT Filed: Nov. 27, 1978

[86] PCT No.: PCT/JP78/00033

§ 371 Date: Jul. 30, 1979

§ 102(e) Date: Jul. 23, 1979

[87] PCT Pub. No.: WO79/00329

PCT Pub. Date: Jun. 14, 1979

[30] Foreign Application Priority Data

Nov. 30, 1977 [JP] Japan ..... 52-144425

[51] Int. Cl.[3] ..... H01J 25/50

[52] U.S. Cl. ..... 315/39.51; 315/39.53; 315/39.71; 315/39.75

[58] Field of Search ..... 315/39.51, 39.71, 39.75, 315/39.77, 39.53

[56] References Cited

U.S. PATENT DOCUMENTS

| | | | |
|---|---|---|---|
| 2,465,211 | 3/1949 | Donal, Jr. et al. | 315/39.71 |
| 2,476,130 | 7/1949 | Becker | 315/39.71 X |
| 3,989,979 | 11/1976 | Konno et al. | 315/39.71 |
| 4,063,129 | 12/1977 | Miura et al. | 315/39.75 |
| 4,075,534 | 2/1978 | Saito et al. | 315/39.71 |

*Primary Examiner*—Saxfield Chatmon, Jr.
*Attorney, Agent, or Firm*—W. G. Fasse; D. F. Gould

[57] ABSTRACT

A magnetron is constructed with an annular wall anode structure including a cylindrical wall first section of smaller diameter or cross-sectional area, and an annular wall second section of greater cross-sectional area. The first and second sections are integrally formed as part of the magnetic circuit and are interconnected by a drawn or flared wall third section in a preferred embodiment. The input and output elements are coupled to the larger second section for enhanced spacing and cooling. The anode and cathode assemblies are mounted primarily in the first section. Internal and external permanent magnet assemblies and enclosures are described with an internal magnetic pole piece for improved lay-out of lead wires and to permit use of solid rod section permanent magnets.

11 Claims, 8 Drawing Figures

FIG. 1
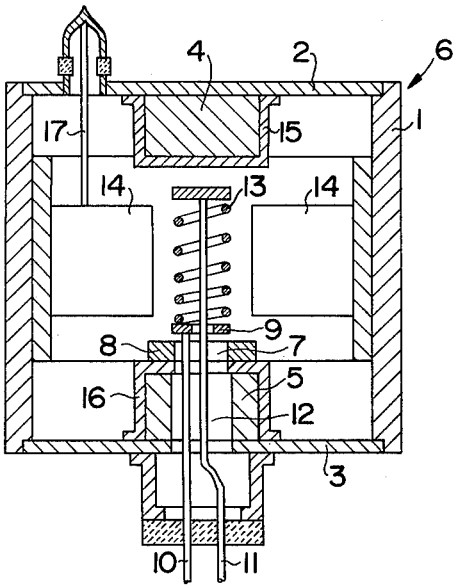
FIG. 3a
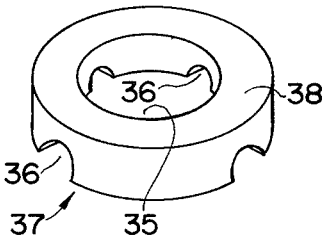
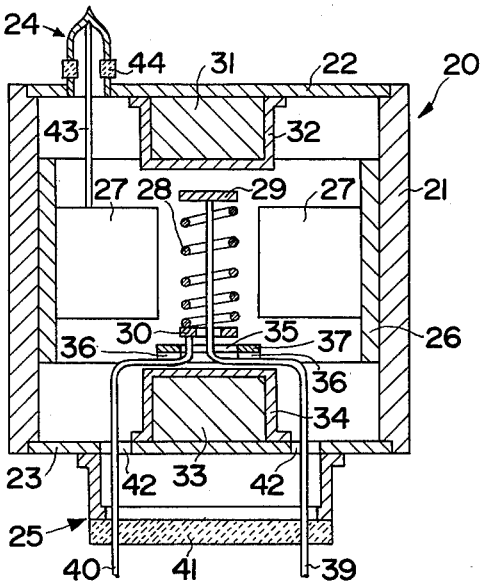
FIG. 2
FIG. 3b
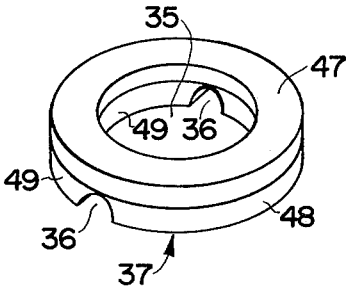

MAGNETRON

CROSS REFERENCE TO RELATED APPLICATION

Applicants claim for this patent application the priority dates of International Application PCT/JP78/00033 filed on Nov. 27, 1978 and the priority Patent Application 52/144425 filed in Japan on Nov. 30, 1977.

DESCRIPTION

1. Technical Field

This invention relates to a magnetron of the self-shielding type, and more particularly to a microwave-generating magnetron of the internal magnet type in which permanent magnets are placed in a magnetic circuit.

2. Background Art

Generally, a magnetron device which generates microwave oscillation by controlling electron current is composed of a cylindrically coaxial diode tube in which a uniform magnetic force is obtained in parallel with the tube axis. Owing to high efficiency, such magnetrons are widely used for high output microwave ovens or industrial heating apparatus. As well known, to achieve high efficient operation by using a compact structure of the self-shielding or internal magnetic type, permanent mangets are placed in a return path of the magnetic circuit. For example, U.S. Pat. Nos. 4,027,194 and 4,048,542, and Japanese published unexamined patent application No. 52-35974 disclose such magnetrons.

Since the permanent magnet in the internal magnet type magnetron is exposed to comparatively high temperature about from 200° to 300° C., Alnicos alloys including an ingredient of cobalt are used for thermal stability rather than easily available ferrites. However, because of scarcity and high value of cobalt, it is necessary to minimize the use and processing of such materials. While the permanent magnet structure has a through hole at the center to pass through cathode leads for supplying electric power as disclosed in U.S. Pat. No. 4,027,149 and Janapense published unexamined patent application No. 52-35974, processing work for such magnet structure becomes costly and difficult and causes undesirable characteristic performance. For instance, the processing of thermally stable Alnico alloys uses the electric discharge forming technique which results in high cost.

Moreover there exist difficulties in surface finishing, and an insufficiently finished magnet can not be used when the magnet is disposed in an evacuated envelope. Magnetic pole pieces have therefore been used to provide more uniform magnetic fields in the working space of the magnetron as well as a variety of arrangements for lead-in of the cathode leads to improve efficiency and effective use of a space. For example, in a customary typical magnetron as shown in FIG. 1, a cylindrical anode 1 and sealing walls 2 and 3 are formed with magnetic materials as a yoke. Permanent magnets 4 and 5 fixed to the inside of the sealing walls 2 and 3 are placed inside of an evacuated envelope 6. At this time, the magnets 4 and 5 are usually made of Alnico alloy or rare-earth metal alloy which is not demagnetized even in the considerably high operating temperature for magnetrons. Because the magnet 5 fixed to the side of cathode lead 10/11 can not be set in the suitable vicinity of the cathode assembly due to its structure, a ring shaped magnetic pole piece 8 with a through hole 7 is disposed between a support plate 9 for the cathode assembly and the magnet 5.

To make the cathode leads 10, 11 as short as possible, these are led through hole 7 and an opening 12 in the magnet 5 for the lead-in structure. Usually, thermally stable Alnico alloy is used than ferrites as magnet materials. Presently, although a cylindrical rod type magnet material for the magnet 5 is processed to form the opening 12, not only the cost of processing becomes very high, but also it is very difficult to remove adhered impurities on the finished surface, and the treatment of the opening 12 is troublesome. Therefore, there is the undesirable result of releasing internal accumulated gas to the inside of the evacuated envelope 6 when the internal magnet type magnetron is operated.

Inside the cylindrical anode 1, a cathode filament 13 is placed along the center line of the cylindrical anode 1, a plurality of anode vains 14 are attached around the cathode filament 13, and magnets 4 and 5 are fixed by non-magnetic supporting members 15, 16 at the inside surface of the sealing walls 2 and 3. An output antenna 17 for oscillating microwaves output is protrudes at the sealing wall 2. The magnets 4 and 5 in the magnetic circuit which is formed by the cylindrical anode 1 and the sealing walls 2 and 3 of the evacuated envelope 6, afford effective magnetic fields to the operating space between anode and cathode, minimizing the mass or quantity of magnets in the magnetron. However, the output antenna terminal protruding at the upper sealing wall 2 prevents full utilizing of space, and unnecessarily enlarges space requirements. Therefore, an improved structure suitable for efficient assembly and for simplified construction has been sought.

DISCLOSURE OF INVENTION

An object of this invention is to eliminate the foregoing defects, and to provide a new and improved magnetron. A feature of the magnetron under this invention is to use a magnetic pole piece at the side of entry of the cathode leads formed with a first hole along the center line and a second hole connected at right angles with the first hole. The cathode leads are taken in through these holes. By means of this lead-in arrangement it is possible to use a cylindrical solid rod permanent magnet without any through hole, even located adjacent the cathode leads. In other words, this invention makes it possible to use a thermally stable Alnicos magnet without any necessity of making the through hole. This simplifies magnet shape as well as increases effective use of magnet materials, to provide a low cost magnetron.

A main feature of the magnetron of this invention is to form a cylindrical anode as a grounding magnetic yoke which serves to form the return path of the magnetic circuit. The body of the cylindrical anode is constructed as an integral member by the power-press forming work with a smaller diameter cylindrical part, a greater diameter cylindrical part and an intermediate connecting part. An input and an output are collectively attached to the greater diameter cylindrical part of the anode to improve cooling effect of the evacuated envelope. For example, the terminals of the input and output are sealed airtightly on the sealing wall at the side of the greater diameter part or portion protrude along the axial direction. In such arrangement, the cooling effect for the vertical or axial direction is increased, and at the same time an effective use of space is attained, whereby a simplified magnetron is provided. Such magnetron structure has a shape of the unidentified flying object, so called UFO type appearance which consists of an integrally formed member having cylindrical portions or portions square or circular cross-section of smaller and greater diameters or cross-sectional areas, and the input and output members are provided on the side of the relatively wider part. Accordingly, when the magnetron of this invention is installed in a microwave oven etc., such magnetron structure is of simplified and agreeable appearance.

Briefly, the magnetron comprises an evacuated envelope forming a return pass of the magnetic circuit and includes a cylindrical anode member and sealing walls airtightly sealed at both ends thereof, anode and cathode assemblies disposed coaxially within the evacuated envelope, permanent magnets placed on the inner surface of each sealing end wall in the magnetic circuit, cathode leads for supplying input power, an output terminal taking out microwave output power, and a magnetic pole piece placed at the side of the cathode leads. One improvement of magnetron structure is characterized by the magnetic pole piece being composed of a ring shape magnetic core provided with a vertical or first hole along the center line and a horizontal or second hole connected at right angles with the vertical hole, to pass the cathode leads through these holes for connecting to external terminals. Further, the evacuated envelope is provided with a smaller and greater diametric parts or portions of smaller and greater cross-sectional area whatever the configuration, wherein the input and output member are disposed together on the greater part. Accordingly, a small and simplified magnetron having desired performance is offered with low cost.

BRIEF DESCRIPTION OF DRAWINGS

FIG. 1 shows a sectional view in part of a prior art magnetron to illustrate plainly differences from the magnetron of this invention;

FIG. 2 shows a sectional view through the main part of the magnetic structure of a magnetron embodying the present invention of a magnetron of this invention;

FIG. 3 shows a diagonal enlarged view of a magnetic pole piece to be used in the magnetron of this invention;

BEST MODE OF CARRYING OUT THE INVENTION

Figure 4:
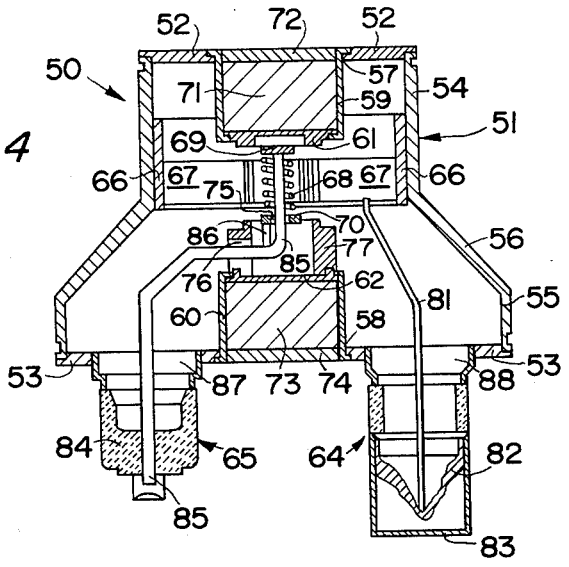
FIG. 4 shows a sectional view in part of a practical embodiment compared with the magnetron shown in FIG. 2.

On the occasion of describing magnetrons according to this invention, a fundamental embodiment is first explained by referring to FIG. 2 and FIG. 3.

The magnetron embodiment of this invention shown in FIGS. 2 and 3 is constructed with anode and cathode assemblies disposed within an evacuated envelope 20 comprising a cylindrical anode 21 made of iron metal and sealing walls 22, 23 made of iron metal, which airtightly seal both end openings of the cylindrical anode 21. A high frequency microwave output member 24 is attached to the sealing wall 22 through which an anode lead penetrates, and a cathode input member 25 is disposed on the sealing wall 23 through which cathode leads penetrates. The anode assembly includes a copper auxiliary cylinder 26 fixed tightly on the circular inner surface of the cylindrical anode 21, and a plurality of even numbered vanes 27, such as twelve disposed radially and extending inwardly the same distance from the inner surface of the auxiliary cylinder 26 to which vanes are electrically and thermally coupled. On the other hand, the cathode assembly includes a cathode filament 28 and support plates 29, 30 respectively provided at each end of the filament 28, and is mounted within a working space defined and bounded by each apex of the plurality of anode vains 27 and at the center line or axis of the cylindrical anode 21 so as to maintain a perfect coaxial relation. Such arrangement allows the evacuated envelope 20 to function as an earth side anode, a path of the magnetic circuit, and a heat transmitting conductor for outward radiation.

To provide a magnetic field for the working space of the magnetron, permanent magnets 31, 33 are used. For example, the magnet 31 made from a material of Alnico alloy is located above the upper support plate 29 by means of a non-magnetic support member 32 on the upper sealing wall 22, and the alnico alloy magnet 33 is located below the lower support plate 30 by means of a non-magnetic support member 34 on the lower sealing wall 23. Permanent magnets 31, 33 are located in the magnetic circuit formed by the evacuated envelope 20, and inside the envelope 20. Generally, such arrangement is so called an internal and inside disposed magnet type magnetron.

In the above internal and inside disposed magnet type magnetron, a magnetic pole piece 37 is located between the lower support plate 30 and the magnet 33 to make the magnetic field in the working space uniform. The magnetic pole piece 37 is formed by a ring shape magnetic chip 38 having a vertical hole 35 along the center line and horizontal holes 36, 36 connected at right angles with the vertical hole 35 at the lower side of the pole piece 37. The magnetic pole piece 37 is fixed on the supporting member 34 covering the magnet 33. The input member 25 which supplies power to the cathode filament 28 of the cathode assembly, is provided with cathode leads 39, 40 connected respectively to either of the upper and lower support plates 29 and 30, and an insulating ceramic plate 41 in which the cathode leads are hermetically sealed. And the insulating ceramic plate 41 is also airtightly sealed to the sealing wall 23 having through holes 42 as a lead-in arrangement.

On the other hand, the output member 24 which takes out microwave oscillation is connected to one of the anode vanes 27 with an output antenna 43, and protrudes from to the sealing wall 22 near opening 44 to let pass the antenna 43 through the opposite side of the envelope from the input member 25. The arrangement of the input and output members and cathode leads 39, 40 is achieved by the use of the magnetic pole piece 37 featured by this invention. In other words, the cathode leads 39, 40 are led through the first or vertical hole 35 extending longitudinally and the second or horizontal holes 36 extending laterally in the magnetic pole piece 37, then bypassing around the permanent magnet 33 along the through holes 42 of the sealing wall 23, and through the ceramic plate 41 to the outside terminals.

Accordingly, it is not necessary to provide any hole in the magnet 33, therefore it is possible to use a cylindrical solid rod magnet, and high cost Alnico series materials effectively and to eliminate comparatively difficult processing. Because such solid rod magnet 33 does not require a hole for passing the cathode leads as in the conventional magnet as shown in FIG. 1, the surface treatment is effected easily and perfectly over all surfaces of the magnet materials. Accordingly, even if a temperature at the inside of the envelope 20 reaches from 200° to 300° C. during magnetron operation, at which temperature internal accumulated gas is easily released, the above solid rod magnet does not release undesirable gas, and is suitable for the internal and inside disposed type magnetron structure with comparatively high efficiency. Also, unnecessary substances which stick to the magnet at the time of the manufacturing process can be removed comparatively easily by the surface treatment before an exhausting process. And although the cathode leads 39, 40 are somewhat elongated by adding the length of the horizontal hole, it has been confirmed that such elongated length of the cathode leads does not cause any substantial disadvantage to the cathode characteristic. Rather it is confirmed that the arrangement of cathode leads 39, 40 located outside and along the opposite side of the magnet 33 reduces heat build-up considerably.

The magnetic pole piece 37 discribed in above embodiment is made of the single ring shaped magnetic material with high permeability, and is provided with the longitudinal vertical hole 35 along the axial direction and lateral horizontal holes 36 at right angles to the vertical hole 35, as shown in FIG. 3(A). However, the number of horizontal holes are not limited to only two holes 36, 36 and a greater number of holes useful in reducing cathode heating power loss, is permitted provided they do not interfere in the primary function of the magnetic pole piece 37 in concentrating magnetic flux.

FIG. 3(B) shows a modification of the magnetic pole piece 37 which is assembled with plural parts to simplify processing of each part and is composed of a single of ring shape magnetic chip 47 and a pair of semicircular chips 48, 49, for a total of three chips. When assembled this pole piece is effectively the same as FIG. 3(A), is also provided with a vertical hole along the axial direction and horizontal holes at right angles to the vertical hole which communicate with each other.

Figure 5:
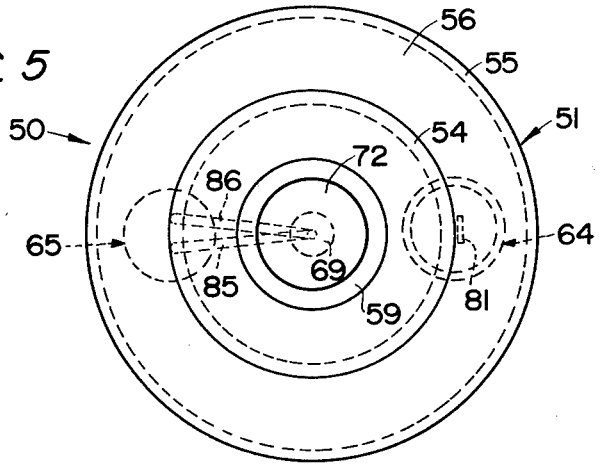
FIG. 5 shows a plan view of the magnetron illustrated in FIG. 4.

Next, the description is made of a practical embodiment as shown from FIG. 4 to FIG. 6. In this embodiment, a magnetron comprises an evacuated envelope 50 which includes a cylindrical anode 51 made of soft iron having good gas characteristics, and sealing walls 52 and 53 which seal openings of the cylindrical anode 51 airtightly. In this embodiment, the cylindrical anode 51 is formed integrally as a single member in terraced shape by drawing of the power-press machine. The stepped anode has a smaller diameter cylindrical part 54, a greater diameter cylindrical part 55, and a tapered middle cylindrical part 56 connecting two parts 54, 55. Around the center axis concentric openings 57, 58 are formed in the upper and lower sealing walls 52, 53, respectively. For receiving and securely mounting magnets, inwardly extended non-magnetic cylinders 59, 60 made of copper are airtightly sealed within respective openings 57, 58 of the the sealing walls 52, 53. Each of sealing iron disks 61 and 62 is also airtightly sealed with respective ends of the non-magnetic cylinders 59, 60. Thus, the evacuated envelope 50 is composed of the cylindrical anode 51 having ends which are sealed airtightly with the sealing walls 52, 53 each of which the concentric openings 57, 58 in which are sealed airtightly with the cylinders 59, 60 and the sealing disks 61, 62. Here, as illustrated in FIG. 4, attention is directed to the fact that the thickness of each of sealing parts to be sealed may advantageously be reduced a sufficient extent to be easily welded in an atmosphere of inactive gas such as argon or helium.

On the sealing wall 53 provided at the side of the greater diameter cylindrical part 55 of the envelope 50 which is formed by the above sealing method, a microwave output member 64 and a power supplying member 65 are provided, extending from the sealing wall. Inside the envelope 50, an anode assembly composed of a copper auxiliary cylinder 66 having good thermal conductivity and twelve anode vanes 67 fixed inside the cylinder 66, and a cathode assembly composed of a cathode filament 68 and support plates 69, 70 placed at both ends of the filament 68 are coaxially mounted similar to FIG. 2. Thermally stable permanent magnets 71, 73 of the cylindrical solid rod type made from a material of Alnico alloy which provides the magnetic field, are placed in cavities formed by the non-magnetic cylinders 59, 60 at the center of sealing walls on the outside of the envelope 50, and the magnets are held by fixed iron yoke disks 72, 74 at outward openings of the cavities respectively. Accordingly, the permanent magnets 71, 73 are placed in a return path for the magnetic circuit which is composed of the cylindrical anode 51, the sealing walls 52, 53, and the iron yoke disks 72, 74, all in the atmosphere on the outside of the evacuated envelope 50, so that a magnetic force can be obtained inside the envelope while the magnets themselves are located outside. The result is a magnetron with an internal field and outside disposed magnets.

Figure 6A:
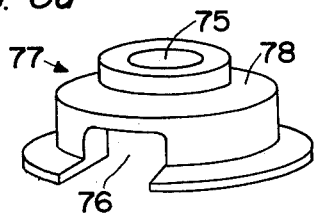
FIG. 6 shows a diagonal enlarged view of a magnetic pole piece which is used in the magnetron illustrated in FIG. 4.
Figure 6B:
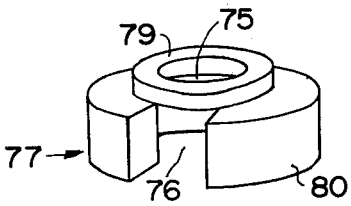

This type is different from the type of FIG. 2, and is free from deterioration of vacuum characteristics in the envelope caused by releasing accumulated gas contained in the permanent magnets 71, 73 so as is intended to improve the magnetron performance. Also, the magnetic pole piece 77 which is another feature of this invention is formed by a ring shape magnetic chip 78 having a vertical hole 75 along the center line and a horizontal hole 76 connected at right angles with the vertical hole. This magnetic pole piece 77 is fixed on the sealing disk 62 covering the magnet 73 placed on the side having the cathode leads. As shown in FIG. 6(A), the magnetic chip is made of a single body with a flange part. But, another type of the magnetic pole piece can be used which is composed including parts of a complete ring shape chip 79 and an incomplete ring shape chip 80 with a cut-out, as shown in FIG. 6(B), on which the complete ring shape chip is firmly mounted. Such magnetic pole piece is able to use the center hole for the vertical hole 75, and the cut-out for the horizontal hole 76. As to another feature of this invention, the members of output 64 and input 65 are attached to extend or protrude from the side of the sealing wall 53 facing outward from the open side or end of the greater diameter cylindrical part 55 of the UFO shape cylindrical anode 51. Thus the output member 64 is attached to protrude from the sealing wall through which one end of an output antenna 81 is passed, the other end of which is connected to one of the anode vains. The top terminal of the outer end is used as an exhausting tip 82 of the evacuated envelope and an impedance matching metal cap 83 covers the tip 82. The input member 65 is also attached to extend on protrude from the same sealing wall through which a pair of parallel cathode leads 85, 86 are led by passing through an insulating ceramic holder 84. The input and output members 64, 65 are hermetically sealed with the sealing wall 53 at through holes 87, 88.

In this arrangement, because the magnets 71 and 73 are placed on the outside of the evacuated envelope, gas released from the magnets does not arise even at a high temperature operation. The cooling effect of the cylindrical anode body 51 by the down-ward flow of air along the axis is excellent. Moreover, because the input and output members are attached together at one side, practical advantages are attained such as effective utilization of space factor. Further, uniform magnetic field in the center line or axial direction caused by the magnetic circuit is attained by the use of adequately precised forms of the ring shaped magnetic pole piece 77 together with arrangement of the sealing disks 61, 62 which are in contact with the magnets 71, 73 respectively.

Figure 7:
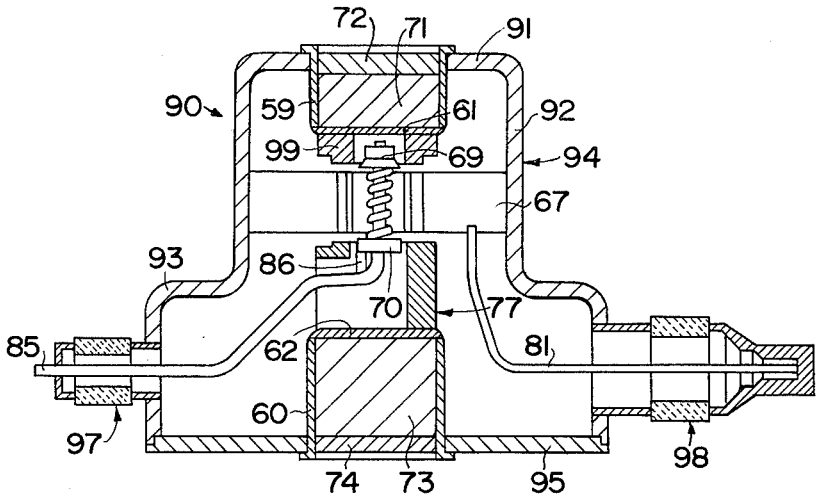
FIG. 7 shows a sectional view in part of another modified embodiment of the magnetron illustrated in FIG. 4; and, FIG. 8 shows a plan view of the magnetron illustrated in FIG. 7.
Figure 8:
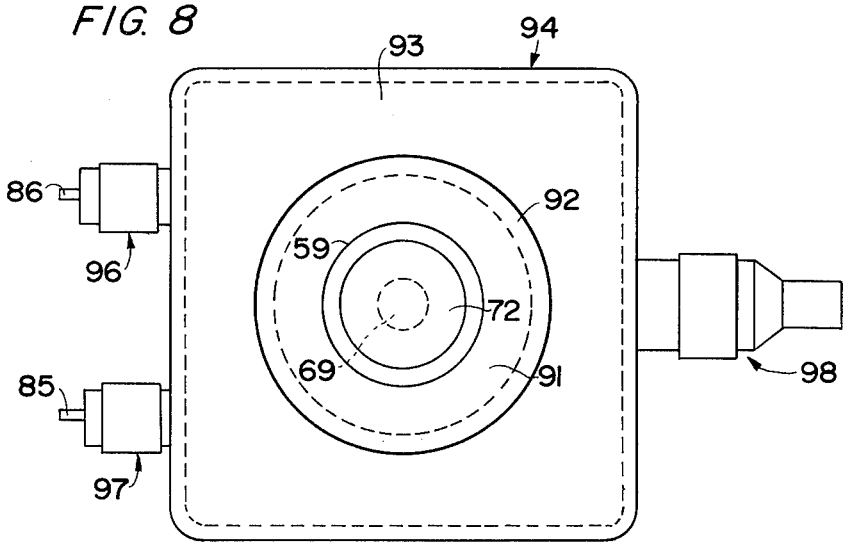

FIG. 7 shows a modification of the magnetron of FIG. 4, in which the greater part of the cylindrical anode is modified by a generally square or rectangular cross-sectional configuration part, and at the same time the input and output members are attached to extend or protrude from the surrounding surface of the square part. As shown in FIGS. 7 and 8, an evacuated envelope 90 is composed of a cylindrical anode 94 which consists of integrally formed member having a smaller diameter cylindrical part 92 with an upper wall 91, the greatest part 93 formed by a section of square pipe and a curved surface middle part connecting the smaller and greater parts. The open end of the greater part is sealed with a sealing wall 95 airtightly. Except for the anode, constitution of this example is similar to the embodiment illustrated in FIG. 4. Namely, permanent magnets 71, 73 are placed in inside the yoke 72 while the magnets themselves are located outside the envelope, providing a so-called internal field and outside disposed magnet type structure.

On the other hwnd, input members 96, 97 connected with cathode leads 85, 86 respectively, and an output member 98 connected with the antenna 81 are attached to protrude or extend from the surrounding side surface of the greater portion or section 93 of greater cross-sectional area, in this case of generally square cross-sectional configuration. Moreover, except for the envelope 90 and input and output members 96, 97, 98, almost the same parts of FIG. 4, are used so that the reference numerals of the embodiment of FIG. 7 correspond to those in FIG. 4 regarding same parts and the respective detailed description is omitted. In addition, the reference numeral 99 indicates a magnetic pole piece located at the side of the envelope opposite the lacking cathode leads.

The lead-in arrangement of the above output and input construction enables the magnetron to be installed securely and with stability on a flat surface utilization of space in longitudinal or vertical direction by eliminating the protrusions at top and bottom. The arrangement of the invention also contributes to simplifying and minimizing cost and materials in the magnetron. Accordingly, when the input and output members are attached to opposite sides of the greater part, it enhances a cooling effect in the axial direction.

In the above described embodiment, the permanent magnet is used in the cylindrical form of a section of solid rod made of Alnico alloy, wherein two magnets are placed in hollow cavities at upper and lower portions respectively as shown in FIGS. 7 and 8, but if a permanent magnet is strong enough, a single magnet will do by placing it at only one side. As a matter of course other magnet materials can be used. Also, in the construction method of placing two magnets as shown in embodiments of FIG. 4 and FIG. 7, the magnet placed in the lower side may be enlarged when the envelope is widened the lower part. Or, the appropriately formed magnetic pole piece may be inserted due to the magnet size to make the magnetic field uniform. In particular, the horizontal hole of the magnetic pole piece which extends perpendicular to the axis is preferably a cut-out like hole along the bottom to enable easy assembly of the cathode leads. While the foregoing description of the magnetron is set forth in the context of internal magnet type construction, it is understood however, that the magnet may be disposed either inside or outside of the envelope. Customarily, magnets are located outside of the envelopes and the anode wall structure. The envelope is formed in the "terraced" shape with multiple stages or portions of differing diameter or cross-sectional area as contemplated by the present invention and described above. The stepped annular side wall anode structure with sealing end walls of the present invention provides a sealing envelope which simplifies the magnetron structure and minimizes component materials.

Industrial Applicability

Magnetrons of this invention are utilized as microwave oscillation sources for microwave ovens or for high frequency heating apparatus. In the production of magnetrons, the leading-in arrangement of this invention provides an advantageous simplified structure and improved efficiency, as well as making manufacturing easier by the simplification of construction. Further, the arrangement of this invention contributes to the high efficiency and high output of the magnetron saves of magnet materials and reduces the cost of the of magnetron.

We claim:

1. In a magnetron comprising an evacuated envelope including an annular wall anode and sealing end walls sealing both ends of the annular wall anode in airtight relationship, said annular wall anode and sealing end walls being made of permeable material forming portions of a magnetic circuit, anode assembly means including a plurality of anode vanes mounted on the inside of said annular wall anode and extending from said wall within the envelopes, cathode assembly means including a cathode filament mounted within said envelope coaxial with the center axis of said annular wall anode and support plate means located at each end of said cathode filament, permanent magnet means positioned adjacent each end of the cathode assembly means, output means for transmitting microwave oscillations including an output antenna extending from said anode assembly means and coupled to said envelope, input means including cathode leads coupled to each of said support plate means of the cathode assembly means, insulating member means mounted in one of said sealing end walls in airtight relationship, said cathode leads passing through said insulating member means in airtight sealing relationship, and a magnetic pole piece mounted within said envelope between one of said permanent magnet means and one of said cathode assembly support plate means, the improvement characterized in that said annular wall anode means comprises a smaller cross-sectional area cylindrical wall first portion and a greater cross-sectional area annular wall second portion, said first and second portions of the annular wall anode being integrally formed, said input and output member means being coupled to the greater cross-sectional area second portion, thereby improving the spacing of components and enhancing the cooling of components in said magnetron.

2. The magnetron of claim 1, wherein said second portion has a generally rectangular cross-sectional configuration.

3. The magnetron of claim 1, wherein said annular wall anode further comprises a drawn or flared third wall interconnecting section integrally connecting said first and second wall portions.

4. The magnetron of claim 1, wherein said anode assembly means is mounted within the smaller diameter first portion of said annular wall anode.

5. The magnetron of claim 1, wherein said magnetic pole piece mounted between one of said permanent magnet means and one of said support plate means of the cathode assembly means comprises ring shaped magnetic chip means formed with a first hole coaxial with the center axis of said annular wall anode and at least one second hole transverse to the direction of said center axis, whereby said cathode leads pass from the cathode assembly support plate means coaxially through said first hole, transversely through a second hole and out of said envelope through the insulating member means thereby not displacing or interfering with other components aligned along the central axis of the magnetron.

6. The magnetron of claim 5, wherein said permanent magnet means are mounted within said envelope and comprise solid cylindrical portions of magnetic material.

7. The magnetron of claim 1, wherein said end sealing walls are formed with hollow enclosure means on the outside of said envelope means and wherein said permanent magnet means are securely mounted in said outside enclosure means.

8. The magnetron of claim 5, wherein said ring shaped magnetic chip means comprises a single body of highly permeable material.

9. The magnetron of claim 8, wherein said second hole extending laterally or transversely from said longitudinal first holes is formed by a cut-out in the chip means ring.

10. The magnetron of claim 5, wherein said ring shaped magnetic chip means is formed by the combination of two or more bodies or pieces.

11. The magnetron of claim 8, 9, or 10, wherein said first hole is formed with a sufficient diameter to afford extension of uniform magnetic fields from the permanent magnet means and coupled magnetic circuit means into the center space of the envelope.

* * * * *